United States Patent [19]

Vandrilla

[11] Patent Number: 4,468,721

[45] Date of Patent: Aug. 28, 1984

[54] CANDLE ASSEMBLIES EMPLOYING A WINDOW SILL LOCKING LEASH

[76] Inventor: Steven Vandrilla, 98 Thompson Rd., Berlin, Conn. 06037

[21] Appl. No.: 493,687

[22] Filed: May 11, 1983

[51] Int. Cl.[3] ..... F21P 1/02

[52] U.S. Cl. ..... 362/392; 362/396; 362/810; 431/289; 431/296

[58] Field of Search ..... 431/125, 289, 296, 297; 248/208, 315, 236, 309 R, 310; 211/87, 89; 362/157, 161, 190, 191, 447, 392, 393, 396, 810; 24/16 PB, 17 B, 30.5 P; D26/5-23

[56] References Cited

U.S. PATENT DOCUMENTS

| | | | |
|---|---|---|---|
| D. 74,986 | 4/1928 | Paul | D26/21 |
| 1,424,573 | 8/1922 | Larson | D26/21 |
| 1,652,825 | 12/1927 | Hechinger | 248/208 |
| 1,790,803 | 2/1931 | Francis . | |
| 2,295,676 | 9/1942 | Meyer . | |
| 2,298,744 | 10/1942 | Liermann . | |
| 2,302,737 | 11/1942 | Bearden . | |
| 2,499,731 | 3/1950 | Derington | 362/810 X |
| 2,686,029 | 8/1954 | Raymond . | |
| 3,161,929 | 12/1964 | Swett | 24/30.5 P |
| 3,584,795 | 6/1971 | Baird | 362/396 |
| 3,596,859 | 8/1971 | MacDonald | 362/396 X |
| 4,335,422 | 6/1982 | Van Ess | 362/396 X |
| 4,392,191 | 7/1983 | White, Sr. | 362/392 |

FOREIGN PATENT DOCUMENTS

| | | | |
|---|---|---|---|
| 300326 | 9/1916 | Fed. Rep. of Germany | 431/289 |

*Primary Examiner*—Margaret A. Focarino

[57] ABSTRACT

A unitary candle retainer leash for use with electric candles and the like to secure them on window sills of double hung windows has an elongated, thin flexible stem dimensioned to extend from the candle and under the window. At one end the leash has means thereon for engagement with the candle and at its other end it has tab means for locking against the outer surface of the window. The leash may be formed as a separate element for engagement with separately purchased candles, or it may be provided as a part of a candle assembly, in one embodiment of which the leash may be substantially retracted into the cavity of a hollow shank of the candle.

18 Claims, 4 Drawing Figures

CANDLE ASSEMBLIES EMPLOYING A WINDOW SILL LOCKING LEASH

BACKGROUND OF THE INVENTION

The present invention relates to means for securing an electric candle of the like on the sill of a double hung window.

Particularly at holiday times, electric candles and the like are placed upon window sills as a form of decoration and frequently as a part of religious observances. Difficulties are encountered in that these electric candles may fall to the floor as a result of accidental contact and by vibrations, causing them to break and sometimes presenting the problem of possible fire through short circuits and the like.

Various means have been proposed to secure such candles in position upon the window sill. However, generally such means are either cumbersome to use, or unattractive, or quite expensive.

It is an object of the present invention to provide a novel leash for securing candles on the window sills of double hung windows and the like, which leash is readily adaptable to window sills of various widths.

It is also an object to provide such a candle retaining leash which may be fabricated readily and relatively economically and which may be used with separately purchased candles.

Another object is to provide a novel candle assembly in which the leash is fabricated as a part thereof to provide a unitary assembly.

Still another object is to provide such a candle assembly wherein the leash may be retracted into the shank of the candle for storage purposes.

SUMMARY OF THE INVENTION

It has now been found that the foregoing and related objects and advantages may be readily attained by use of a unitary candle leash which comprises an elongated thin, flexible stem dimensioned to extend from the associated candle and under the associated window. The leash is provided at one end with means for engagement with the associated candle, and at its other end with tab means for locking against the outer surface of the associated window.

In one embodiment, the candle engagement means comprises an enlarged portion with an aperture therethrough dimensioned to receive the shank of the candle, and this enlarged portion is desirably of generally annular configuration.

In another embodiment, the leash is formed as a unitary portion of candle assembly wherein the candle has a base and a shank and the leash extends from the shank on the window as in the prior embodiment. In such an assembly, the candle shank desirably has a cavity therein and an aperture through the wall defining the shank and opening into the cavity. The stem extends through the aperture into the cavity and its inner end has an enlarged portion engageable with the candle wall about the aperture to retain the one end of the leash therein.

Conveniently, the tab means engageable with the window surface comprises an upstanding button providing a rigid stop for abutment against the associated window.

The retainer leash is integrally formed of synthetic resin which retains good flexural characteristics at low temperatures. Desirably, the resin exhibits resilient deformability to permit the annular engagement portion to adapt to candle shanks of varying dimension and to absorb some of the stresses occurring during usage.

DETAILED DESCRIPTION OF THE ILLUSTRATED EMBODIMENTS

Figure 1:
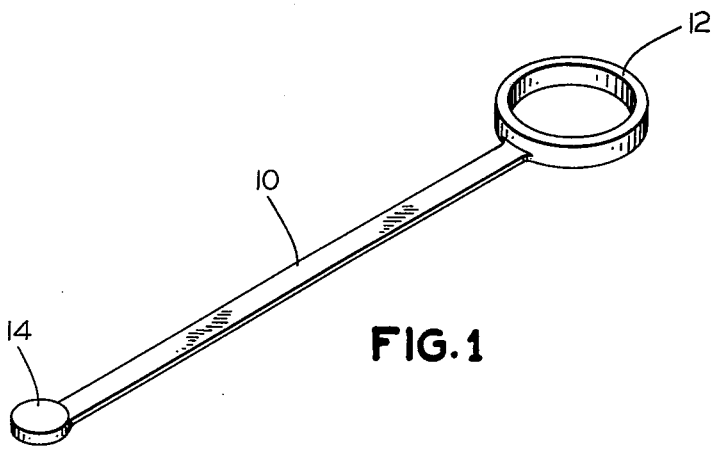
FIG. 1 is a perspective view of a separate candle leash embodying the present invention.
Figure 2:
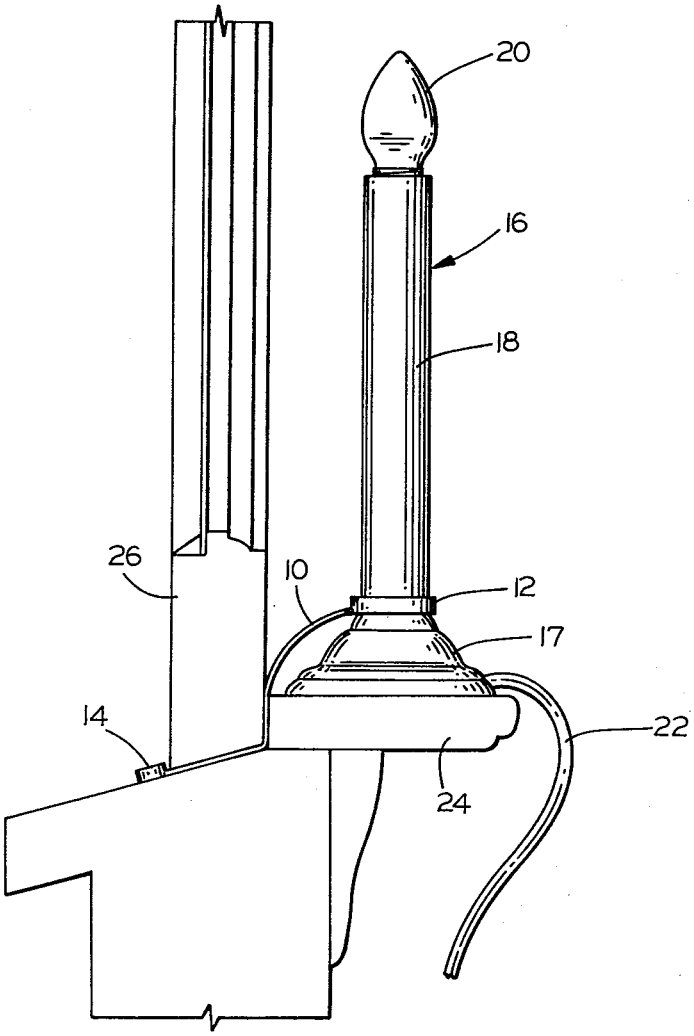
FIG. 2 is a fragmentary sectional view of a window sill and window with an electric candle held upon the window sill by the leash of FIG. 1.

Turning first to the embodiment of FIGS. 1–2, therein illustrated is an integrally formed leash embodying the present invention having an elongated stem portion 10, a candle-engaging annular portion 12, at one end thereof and a tab portion 14 at the other end thereof. The material from which the leash is fabricated is a synthetic resin affording good flexural characteristics even at low temperatures and providing some degree of flexibility, so that the annular candle engaging portion 12 may be forced about a somewhat larger than normal shank of a candle assembly.

As seen in elevation in FIG. 2, the candle-engaging portion 12 is of somewhat greater thickness than the leash stem portion 10 which must bend sharply underneath the window 26 which is closed thereon and therefore must retain a very high degree of flexure. The enlarged thickness tab portion 14 acts as a stop when it abuts against the outer surface of the window 26 in the event that the candle should fall or someone should attempt to dislodge it from the window sill.

Turning now in detail to FIG. 2, therein illustrated is a conventional electric candle generally designated by the numeral 16 having a base 17, a shank 18, a bulb 20 and an fragmentarily shown electric cord 22. The base 17 of the candle 16 is seated on the window sill 24, and a conventional double hung window 26 is fragmentarily illustrated. The annular portion 12 of the leash is slid downwardly about the shank 18 of the candle 16, and the elongated stem 10 extends therefrom along the outside surface of the sill 24 and under the lower edge of the window 26. The tab portion 14 is disposed outwardly of the window 26 and will abut against the outer surface thereof in the event that the candle 16 should move towards the edge of the sill 24 disposed towards the interior.

By controlling the angle at which the stem 10 extends from the candle 16 and under the window 26, the tab portion 14 can be located closely adjacent to the outer surface of the window 26, thus minimizing the distance that the leash might be pulled before the tab portion 14 abuts against the outside surface of the window 26.

Figure 3:
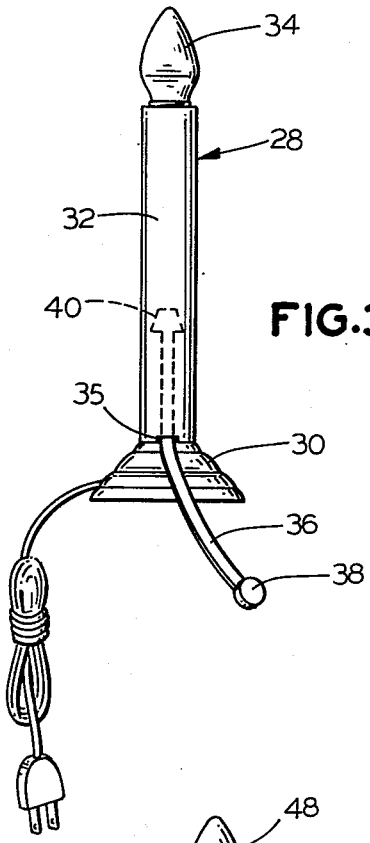
FIG. 3 is an elevational view of an electric candle and leash assembly embodying the present invention; and with the cross hatching omitted for clarity.

Turning now to FIG. 3, therein illustrated is a leash and candle assembly embodying another form of the present invention. The candle generally designated by the numeral 28 has a base 30 a shank 32 and a bulb 34. In this instance, the shank 32 is hollow providing an interior cavity, and an aperture 35 extends through the wall of the shank 32 to provide an opening into this interior cavity. In this embodiment, the leash has an elongated stem 36 and an enlarged tab portion 38 at the outer end of the stem 36, and an enlarged head portion 40 at the end of the stem 36 disposed inwardly of the cavity in the shank 32 of the candle 28. The sides of the head portion 40 taper to a larger width adjacent the stem 36 so that the head 40 can be cammed inwardly of the aperture 35 for initial insertion and so as to prevent withdrawl of the head portion 40 therefrom during usage.

In this embodiment, the stem 36 can be pushed inwardly into the cavity of the shank 32 for storage purposes leaving only a relatively short portion thereof and the tab portion 38 projecting outwardly therefrom.

Figure 4:
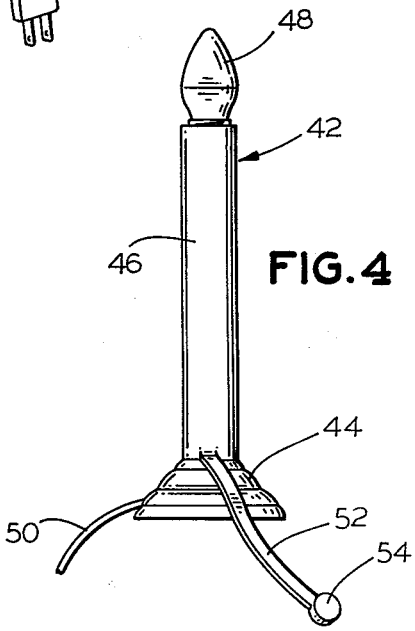
FIG. 4 is an elevational view of another electric candle and leash assembly embodying the present invention.

Turning now to the candle embodiment of FIG. 4, the candle assembly illustrated therein is generally designated by the numeral 42 and has a base 44, a shank 46 and a bulb 48 as well as the electric cord 50. In this embodiment, the inner end of the stem 52 of the leash is made integral with the wall of the shank 46 of the candle 42. As in the prior embodiments, the outer end of the stem 52 is provided within an enlarged tab portion 54 to lock against the outside of the window.

In each of the illustrated embodiments, it can be seen that the leash provides the means for securing the candle upon the window sill and substantially preventing the likelihood of its falling to the floor as a result of drafts, of being brushed against by persons or animals, or of vibrations. The leash can be of a length larger than required to secure the candle in position upon the sill since the angular disposition of the leash under the window can be used to compensate for any excess length.

The resin from which the leash is formed should be one which exhibits good flexural characteristics even at low temperatures which the portion underlying the window and outwardly thereof may encounter. Among the resins which may be employed are low density polyethylene, high density polyethylene, polypropylene, ethylene/propylene copolymers, polyurethane and the like. From the standpoint of cost, low density polyethylene has been found highly satisfactory for most applications.

The thickness of the stem portion would normally be on the order of 1/16 to 3/16 inch and preferably about $\frac{1}{8}$ inch. The width of the leash may vary from $\frac{1}{8}$ to $\frac{1}{2}$ inch and is preferably on the order of 3/16 to 5/16 inch. The upstanding tab at the outer end of the leash may assume any convenient configuration and its height above the thickness of the stem may be as little as 1/16 inch, although it is preferably on the order of $\frac{1}{8}$ to $\frac{1}{2}$ inch. Although a polygonal configuration presenting a generally planar face for abutment against the window would have some advantages from the standpoint of increasing the abutment area, a cylindrical tab is most convenient from the standpoint of molding as a part of the configuration. Cylindrical tabs of about $\frac{1}{4}$ to $\frac{3}{4}$ inch diameter have proven highly effective.

The candle engagement portion of the leash may have various configurations. However, from the standpoint of cost and ease of molding, the illustrated annular configuration has proven highly advantageous. Moreover, it provides the minimum visible portion of the leash about the candle from the standpoint of aesthetics. It is desirable that there be radius between the stem of the leash and the candle engagement portion in order to minimize stress points and possible areas for fracture.

The length of the stem portion may vary from 4 to 9 inches and is preferably on the order of 5 to 7 inches. From the standpoint of providing a reasonable range of size utilization, the candle retaining portion desirably has a circular aperture of about $\frac{3}{4}$ to $1\frac{1}{2}$ inch diameter and preferably on the order of $\frac{7}{8}$–$1\frac{1}{8}$ inches. The polymers identified above all provide some degree of resilient deformability so that a slightly larger or candle shank can be accepted therewithin by stretching of the plastic thereabout.

Thus, it can be seen from the foregoing detailed specification and the attached drawings that the candle leash of the present invention provides a convenient and highly facile means for securing an electric candle or the like on the sill of a conventional double hung window or the like. The leash may be readily fabricated, and may be easily utilized in connection with existing candles if provided as a separate leash element. Alternatively, candle assemblies providing a retractable leash or a fixed leash may also be fabricated at relatively low cost and utilized in the same manner.

Having thus described the invention, I claim:

1. In combination:

A. a candle having a shank; and

B. a unitary candle retainer leash for use on window sills of double hung windows and the like comprising an elongated, thin flexible planar stem extending from said candle and dimensioned to extend from said candle when placed on a window sill and under the associated window, said leash being formed from a resin exhibiting good flexural characteristics at low temperatures, said stem being not greater than 3/16 inches thick and of at least about 4 inches in length and being sufficiently flexible and thin to bend readily about the inside edge of the associated window sill and about the lower edge of the associated window so as to avoid interference with the closing of the associated window, means at one end of said stem engaged with said candle, and upstanding tab means of at least about $\frac{1}{8}$ inches in height at the other end thereof providing an upstanding abutment surface for locking against the outer surface of the associated window.

2. The candle and retainer combination of claim 1 wherein said candle engagement means comprises an enlarged portion with an aperture therethrough dimensioned to receive the shank of said candle.

3. The candle and retainer combination of claim 2 wherein said enlarged portion is of generally annular configuration and said candle shank is seated therewithin.

4. The candle and retainer combination of claim 1 wherein said candle engagement means is an enlarged head portion engageable with the inner surface of the wall about an aperture in said candle shank.

5. The candle and retainer combination of claim 1 wherein said tab means comprises an upstanding button providing a rigid stop for abutment against the associated window.

6. The candle and retainer combination of claim 1 wherein said retainer leash is integrally formed of synthetic resin exhibiting good flexural characteristics at low temperatures.

7. The candle and retainer combination of claim 6 wherein said resin exhibits resilient deformability to adapt to candle shanks of varying dimension.

8. In combination:

A. a double hung window having a sill and a vertically movable window;

B. a candle having a shank and seated on said sill; and

C. a unitary candle retainer leash comprising an elongated, thin flexible planar stem extending from said candle and outwardly under said window, said leash being formed from a resin exhibiting good flexural characteristics at low temperatures, said stem being not greater than 3/16 inches thick and of at least about 4 inches in length and being sufficiently flexible and thin to bend readily about the inside edge of the said window sill and about the lower edge of the said window so as to avoid interference with the closing of said window, an enlarged portion at one end of said stem with an aperture therethrough seating therein said shank of said candle, and upstanding tab means of at least about ⅛ inches in height at the other end thereof providing an upstanding abutment surface for locking against the outer surface of said window to prevent said candle from falling from said sill.

9. The combination of claim 8 wherein said enlarged portion is of generally annular configuration.

10. The combination of claim 8 wherein said tab means comprises an upstanding button providing a rigid stop for abutment against said window.

11. The combination of claim 8 wherein said retainer leash is integrally formed of synthetic resin exhibiting good flexural characteristics at low temperatures.

12. The combination of claim 11 wherein said resin exhibits resilient deformability to adapt to candle shanks of varying dimension.

13. A unitary candle and retainer leash assembly comprising:

A. a candle having a base and a shank, said candle shank having a cavity therein and an aperture through the outer wall defining said shank and opening into said cavity; and B. a unitary leash for use on window sills of double hung windows and the like comprising an elongated, thin flexible planar stem having one end thereof extending through said aperture in said wall of said shank and into said cavity, said one end being engaged with said shank, said stem being dimensioned to extend from said candle and under the associated window, said leash being formed from a resin exhibiting good flexural characteristics at low temperatures, said stem being not greater than 3/16 inches thick and of at least about 4 inches in length and being sufficiently flexible and thin to bend readily about the inside edge of the associated window sill and about the lower edge of the associated window so as to avoid interference with the closing of the associated window, said leash having upstanding tab means of at least about ⅛ inches in height at the other end thereof providing an upstanding abutment surface for locking against the outer surface of the associated window.

14. The candle and leash assembly of claim 13 wherein said stem extends through said aperture into said cavity and said one end of said stem has an enlarged portion engageable with said candle wall about said aperture to retain said one end of said leash therein.

15. The candle and leash assembly of claim 14 wherein said cavity is dimensioned to receive substantially the entire length of said stem for storage thereof.

16. The candle and leash assembly of claim 13 wherein said tab means comprises an upstanding button providing a rigid stop for abutment against the associated window.

17. The candle and leash assembly of claim 13 wherein said retainer leash is integrally formed of synthetic resin exhibiting good flexural characteristics at low temperatures.

18. The candle and leash assembly of claim 17 wherein said resin exhibits resilient deformability to adapt to candle shanks of varying dimension.

* * * * *